United States Patent [19]

Fox, Jr. et al.

[11] 4,186,455

[45] Feb. 5, 1980

[54] COMPOSITE WATER BED MATTRESS

[76] Inventors: Moroni Fox, Jr., 1568 Stonemore Cir., Salt Lake City, Utah 84121; Moroni Fox, Sr., 2760 Claybourne Cir., Salt Lake City, Utah 84109; Dana G. Fox, 4467 Nancy Dr., Salt Lake City, Utah 84120

[21] Appl. No.: 876,132

[22] Filed: Feb. 8, 1978

[51] Int. Cl.[2] ..... A47C 27/08

[52] U.S. Cl. ..... 5/451; 5/474; 5/481

[58] Field of Search ..... 5/349, 350, 365-371, 5/334 R, 335

[56] References Cited

U.S. PATENT DOCUMENTS

| | | | |
|---|---|---|---|
| 4,055,867 | 11/1977 | Phillips | 5/371 |
| 4,057,862 | 11/1977 | LaBianca | 5/370 |
| 4,062,077 | 12/1977 | Autrey et al. | 5/365 |

FOREIGN PATENT DOCUMENTS

| | | | |
|---|---|---|---|
| 1220698 | 5/1960 | Fed. Rep. of Germany | 5/370 |

*Primary Examiner*—Casmir A. Nunberg
*Attorney, Agent, or Firm*—Trask & Britt

[57] ABSTRACT

A composite water bed mattress construction having a thickness similar to conventional mattresses and having a peripheral restraining member to provide a lateral support in all directions with a foam member interposed between said restraining member and a flexible bladder for holding a body of water is disclosed. Construction generally includes an intermediate foam restraining member or members having a height of at least as great as the bladder when said bladder is filled with water. Also, a foam cushion is superposed upon the peripheral restaining member and generally overlying the intermediate foam member to provide an outer peripheral surface for the mattress which is comfortable to sit upon.

20 Claims, 9 Drawing Figures

COMPOSITE WATER BED MATTRESS

BACKGROUND OF THE INVENTION

1. Field

The instant invention relates to composite water bed mattress structures which have a thickness, width and length comparable to conventional single, double, queen and king size mattresses. Composite water bed mattresses are generally supported upon a rigid box-like structure and have a weight substantially less than a conventional water bed.

2. Prior Art

In recent years, the bedding industry has developed a hybrid mattress which is a cross between a conventional water bed and a conventional innerspring or foam mattress. These hybrid or composite mattresses have a thin, for example, three inches to six inches in depth, water filled bladder and some means of restraining the bladder laterally. Generally, a foam cushion means rests upon the bladder to insulate the sleeper's body from the water bladder and to reduce some of the vibrations and waves caused by any motion upon the water-filled bladder.

Typical composite water bed mattresses which have been developed in recent years include the structures disclosed in Tinnel, U.S. Pat. No. 4,015,299; LaBainco, U.S. Pat. No. 3,840,921; Tobinick, U.S. Pat. No. 3,702,484; Autrey et al, U.S. Pat. No. 4,062,077; Alsbury, U.S. Pat. No. 3,742,531; Weinstein, U.S. Pat. No. 3,689,945.

The following patents, although directed to a more conventional water bed structure disclose structures which are germane to composite water bed mattress structures. Examples of such patents include Carson, U.S. Pat. No. 3,736,604; Hall; U.S. Pat. No. 3,585,356; and Kretin, U.S. Pat. No. 3,735,432.

Other patents disclosing structures relating generally to water beds or structures which may be adapted in certain aspects to composite water beds include the following: U.S. Pat. Nos. 3,778,852 (Penn); 3,787,908 (Beck); 3,864,768 (Fraige); 4,042,986 (Goodman); 3,581,322 (Marsico); 2,481,833 (Foster); 3,849,814 (Ross); 3,958,286 (Rodinsky); 3,308,491 (Spence); 1,371,362 (Giese); 3,728,747 (Docker); 3,864,767 (Adams).

Each of the above-described patents has certain advantages and disadvantages. For example, in Autrey et al the vertical rigid restraining member is adjacent the bladder and must be substantially the same height as the bladder to avoid pinching the bladder against the upper surface of the rigid restraining member. Thus, if the bladder has a substantial thickness, for example four to six inches, the rigid restraining member height must be about the same height, allowing very little foam cushioning above the restraining member's thin edge inasmuch as conventional composite mattresses have a thickness from about six to eight inches. Thus, the restraining member is readily detected and is uncomfortable to sit upon or to lie upon when a bladder of about four inches or more in thickness is used. If thinner bladders are utilized in the Autrey et al structure then the water bed effect is substantially diminished.

In the Tinnel structure the restraining wall is a unitary foam construction. It is a flexible foam so it is comfortable to sit on, however, once the bladder is filled there is some tendency of the side walls of the structure to bow because the hydrostatic pressures involved. Also, since the foam depresses significantly whenever anyone sits upon an edge, the safety reservoir feature is diminished since the upper level of the liner is then moved to a position lower than the bladder height. In such an event, water spills out if the bladder has a major leak and water has filled the reservoir.

In Kretin et al the rigid retaining members have a substantial vertical dimension which brings a thin edge to a position relatively close to the upper foam surface.

OBJECTS OF THE INVENTION

It is an object of the instant invention to provide a composite water bed structure which is easy to fabricate and provides a comfortable sleeping surface compatible with a peripheral surface which is comfortable to sit upon.

A further object of the instant invention is to provide a composite water bed mattress which has external dimensions comparable to conventional inner spring or foam mattresses and which has a durable structure.

A further object of the instant invention is to provide a rigid peripheral member which has a minimal height and is substantially undetectable by a person sitting upon the edge of the mattress.

An additional object of the instant invention is to provide a composite water mattress wherein the peripheral restraining member is a composite member of relatively flexible foam and a more rigid material to provide a peripheral seating surface which is comfortable while providing ample lateral support for the water-filled bladder.

SUMMARY OF THE INVENTION

The instant invention relates to composite water bed mattresses generally having a thickness of about six to about eight inches. A water bladder for holding a body of water is contained laterally by a flexible foam restraining border having a height substantially equal to or greater than the bladder when the bladder is filled with water. An outer peripheral restraining member which is more rigid than the intermediate foam restraining member forms a box-like structure for offering the necessary lateral support to equal the hydrostatic pressure from the water filled bladder. A foam cushion is generally superposed over the water bladder, intermediate cushion and peripheral rigid restraining member. The cushion may be an integral construction or a separate construction with varying thicknesses of foam over the rigid peripheral member, the intermediate foam member and the water filled bladder.

In another embodiment of this invention, the peripheral restraining member which restrains the water bladder and provides a cavity for same is a composite structure having materials of different rigidity wherein a thin substantially rigid material of substantial width is used. In some structures the rigid material may extend in width from the outer edge of the water bladder to the outer edge of the mattress. In certain embodiments, it is preferred that this thin rigid member be sufficiently thin that it will flex from vertical forces but will not flex on the imposition of lateral forces. Further description of the invention may be facilitated by reference to the following drawings.

Figure 1:
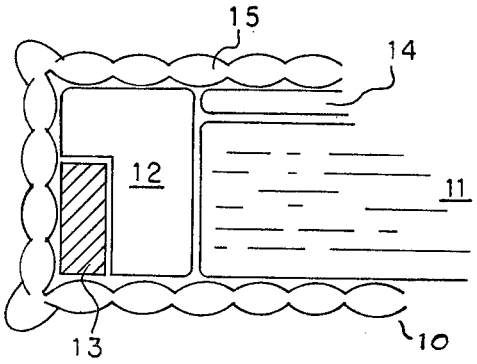
FIG. 1 is a cross-section view along one side of a composite water bed mattress having an external rigid support member.

FIG. 1 illustrates a composite water bed mattress 10 having a water filled bladder 11 supported peripherally by a foam cushion 12 which is generally a relatively flexible foam, which in the embodiment illustrated is of an irregular shape. The surface of the foam in contact with the water bladder is substantially higher than the bladder. The foam cushion extends laterally to the outer edge of the mattress to provide a substantial thickness of foam above the rigid peripheral frame member 13.

It is generally preferred that the cushion 12 extends in a circumscribing manner around the complete peripheral surfaces of the water bladder 11. However, if desired, the foam cushion may extend only along the longer dimensions (sides) of the mattress since it is a primary objective of the instant invention to provide a comfortable seating means for people sitting upon the edges of the mattress. Since it is less common for persons to sit at the foot of the bed and generally impossible for them to sit at the head of the bed, the water bladder may extend to the foot and head of the bed to make contact with the rigid restraining members across the foot and head of the bed. In such instances, the rigid restraining member across the foot or head of the bed may be of a greater height than the restraining member along the sides of the mattress.

Generally, it is preferred that the rigid restraining member 13 along the sides of the mattress have a height less than the height of the water filled bladder so that a substantial thickness of foam may be superposed above the restraining member to make the restraining member substantially undetectable by any one sitting on the edge of the bed.

It is an advantage of the instant structure to have the restraining member at the outer periphery of the mattress rather than adjacent the water bladder 11. A restraining member of substantial height in either location may be detected by someone sitting on the edge of the bed while a restraining member adjacent the bladder may also be detected by someone lying on the bed. A rigid restraining member 13 at the periphery of the mattress is less likely to be felt by anyone lying on the bed since it is not a common sleeping practice of people to sleep at the very edge of the mattress. Also, a restraining member 13 at the outer periphery of the mattress need not be as high as one adjacent the bladder and thus be more difficult to detect by anyone sitting on the edge of the bed.

A foam pad 14 is placed above the water bladder 11 to insulate the bladder from those sleeping upon the mattress. The water within water mattresses tends to be at room temperature, which even at 70° F. feels cold to a person sleeping upon the mattress. Thus, the overlying foam pad retains the body warmth next to the person sleeping upon the mattress and does not allow it to be dissipated by the water-filled bladder. A coverlet 15, which is preferably quilted, is illustrated as encompassing the whole mattress structure. In a preferred embodiment the coverlet has a zipper across the entire foot of the mattress and partially up each side so that it may be slipped over the mattress structure and then zipped to make an integral body.

Although it is not necessary, the foam cushion 12 may be secured to the rigid member 13 by adhesives or other means. Also, the coverlet 15 may be made in a conventional manner with cotton or foam padding to provide the appearance of a conventional innerspring mattress.

Figure 2:
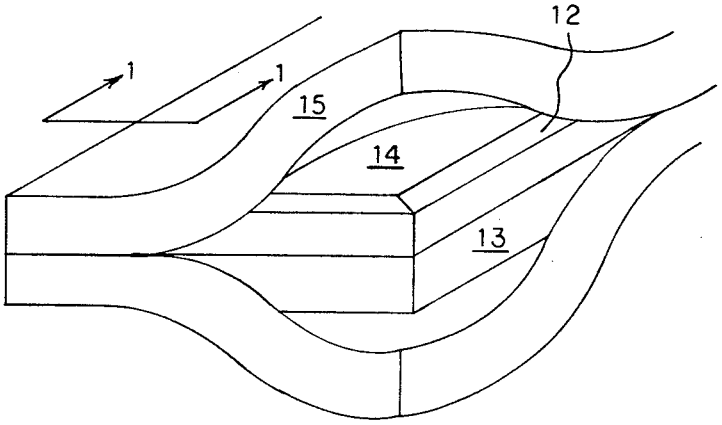
FIG. 2 is a perspective view of a composite or hybrid water bed mattress structure of the type illustrated in FIG. 1.

FIG. 1 is a cross-sectional view along the side support of the mattress construction illustrated in FIG. 2. As indicated hereinbefore, this composite mattress structure is supported upon a substantially rigid base. The composite mattress structure is dimensioned so that it will accept fitted sheets which are made for conventional single, double, queen and king size mattresses. Thus, the structure combines many of the advantages of a water bed with many of the advantages of conventional innerspring or foam mattress structure.

FIG. 2 is a perspective view of the mattress on a box frame of substantial rigidity. The quilted cover 15 is pulled back along with the foam pad to show the juxtaposition of the mattress and intermediate foam cushion.

Figure 3:
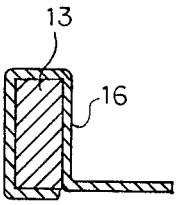
FIG. 3 is a cross-sectional view similar to FIG. 1 of a mattress having a safety liner.

FIG. 3 is similar to that illustrated in FIG. 1 showing the addition of a vinyl liner 16 which passes under the bladder and foam cushion and lays vertically along the interior wall of the rigid frame member 13. The liner wraps about the rigid frame work and terminates beneath the rigid frame work or the adjacent cushion 12. The impervious vinyl liner serves as a safety reservoir for any water which should accidentially leak from the bladder.

In the construction illustrated in FIG. 3, the foam retainer 12 would be exposed to any water leaking from the bladder and would have to be dried in the event of any substantial spillage of water.

Figure 4:
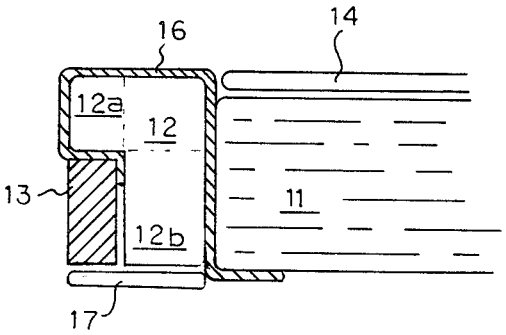
FIG. 4 is a cross-sectional view similar to FIG. 1 showing segmented foam cushion members.

The embodiment of FIG. 4 utilizes a vinyl liner 16 which is a large rectangular sheet disposed beneath bladder 11 and having sufficient length and width to be disposed between the retaining cushion 12 and the bladder and to wrap about the retaining cushion to terminate at a position between the rigid frame work member 13 and the cushion 12. In this construction any water within the safety reservoir would be isolated from the foam. Also, in this construction any lateral hydrostatic pressure exerted by the water filled bladder on the cushion 12 would tend to pull down on the vinyl liner 16 thus substantially precluding the cushion 12 from being compressed laterally or extending itself vertically.

As shown in the dotted line in FIG. 4, the retaining cushion 12 may be made into segments, that is, 12*a* and 12*b*.

These segments may be glued together or held in place by the coverlet which encompasses the whole structure. An advantage of having these parts in two pieces is that standard thicknesses and widths of foam may be utilized. Also, in FIG. 4 an underlying foam pad 17 is illustrated which underlies the rigid retaining wall 13 and the bottom portion of the intermediate cushion 12. This foam pad may be relatively thin, for example from one-half inch to one inch. It serves primarily to soften the feel of the lower edge of the retaining wall whenever anyone picks up a corner of the mattress to turn a sheet under same. Cushion 17 may be a large rectangular piece which underlies the complete structure. Also, if desired, the cushion 17 may be adhered to either retaining member 13 or cushion 12 or to both members.

The structures illustrated in FIGS. 1 through 4 all show foam pad 14 as overlying only the bladder 13. It is, of course, understood that the pad may overlie the bladder and the retaining cushion 12. This is particularly true when the cushion 12 is the same height as the filled bladder. Also, an additional pad may be added above pad 14 wherein pad 14 is at about the same level as the top of cushion 12 and an additional cushion overlies the whole structure.

The structures illustrated in FIGS. 1 through 4 are constructed so as to have a seating surface width of about four to six inches along each side of the mattress and optionally at each end of the mattress. Thus, the width of the upper surface of cushion 12 is generally from about four to eight inches although it may be slightly smaller or greater if desired. Also, the height of the bladder when filled, is generally from about four to six inches with an approximately four inch depth being preferred.

In the structures illustrated in FIGS. 1 through 4, the retaining member 13 need not be as high as the filled bladder inasmuch as it is not adjacent to the bladder and there is no danger of pinching. Also, the cushion 12 tends to distribute the hydrostatic forces and while the cushion may deform to some extent, a rigid retaining member 13 which is about one-half the height of the bladder 11 will offer sufficient lateral support so that the cushion is not noticeably deformed.

Most of the hydrostatic pressure in the bladder is exerted in the lower half of the bladder. Thus, a retaining member which is at least one-half the height of the bladder will be in a direct line with the maximum lateral forces exerted by the bladder. The portions of foam cushion 12 which extend above the retaining member are not subjected to hydrostatic pressures as great as the lower portions and are not noticeably deformed. Also, the retaining cushion 12 tends to diffuse the pressure exerted against it so that most of the lateral forces are exerted upon the retaining member 13. Also, the vinyl liner which forms the safety reservoir may be adhered to the intermediate foam cushion so that the depth of the reservoir is equal to the vertical thickness of the waterfilled bladder.

An upright retaining member which is higher than it is thick may be made of wood, plastic, aluminum channel or similar rigid material. The height of the retaining member is preferably about two to three inches and is generally four inches or less in the structures of FIGS. 1 to 4.

The foam cushion 12 is preferably a resilient material which is very flexible, although it may be constructed similar to the structures shown in FIGS. 5 through 8 wherein the lower portion of the foam is a more rigid foam.

Figure 5:
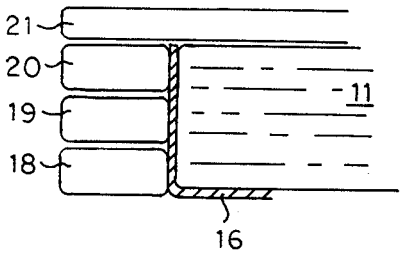
FIG. 5 is a cross-sectional view illustrating the composite plastic foam border for supporting a water-filled bladder for a water bed.

In FIGS. 5 through 8, a composite water bed mattress is disclosed wherein the surrounding retaining structure circling the water filled bladder is a foam structure having a more rigid foam at its base and a more flexible foam near the surface of the retaining structure. FIG. 5 illustrates such an embodiment wherein a water filled bladder 11 is encircled by a substantially rigid foam 18.

The structure shown in FIG. 5 comprises a water-filled bladder 11 with a vinyl liner 16 interposed between the foam retaining wall and the bladder and passing underneath the bladder to form a safety reservoir in the event of any water spillage. The cross-section of the foam retaining wall shows a foam panel 18 of sufficient rigidity to provide an effective lateral retaining wall for a water-filled bladder. Preferably, the foam section 18 encircles the whole bladder. The foam material in panel 18 is preferably of a greater density and higher rigidity than the foams which are superposed thereon. Foam 19 may be of the same density and rigidity as foam 18, although preferably it is of a lower density and is a semiflexible foam while foams 20 and 21 are of successively lower densities and increasing flexibilities.

As indicated hereinabove, the hydrostatic pressure of a body of water is greatest at its base. Thus, the greatest lateral force exerted by the water-filled bladder will be in the lower half of the bladder. The structure illustrated in FIG. 5 is a retaining wall employing a variable rigidity principle wherein the lower foam members are more rigid and generally of greater density than the upper foam members. This structure minimizes any sagging from use, that is fatigue, while providing a very comfortable retaining wall for those desiring to sit on the side or end of the bed. Also, this structure provides a very comfortable interface between the water filled mattress and the retainer wall so that those sleeping on the bed notice little difference in softness and support when sleeping partly on the retaining wall and partly upon the water filled mattress.

A quilted-type coverlet 15 similar to that illustrated in FIG. 1, is preferably utilized to enclose the whole structure. If desired, the vinyl liner may be adhered to the composite retaining wall or interposed between a pair of adjacent foam panels. Preferably each of the foam slabs are adhered to one another to form an integral structure.

Figure 6:
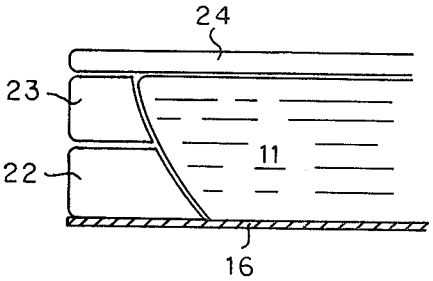
FIG. 6 is a cross-sectional view of a structure similar to that illustrated in FIG. 5 utilizing fewer panel members on the border.

FIG. 6 is a water mattress structure with a slight variation upon the structure illustrated in FIG. 5. In FIG. 6 a dense foam 22 of a rigid or partially rigid nature is formed with a slanting edge towards the bladder. A vinyl liner 16 is adhered to the base of the foam structure 22 to form a coffer or reservoir for the bladder. The vinyl liner serves two purposes in this instance. First, it forms a reservoir in conjunction with the foam walls to hold in any water which seeps from the bladder and, secondly, it provides lateral support for the foam to prevent it from being bowed by the hydrostatic pressure exerted laterally by the water filled bladder. Adhered to the top surface of the first foam section 22 is another foam section 23 of a lower density and, preferably, more flexible than the foam of section 22. Section 23 also has a sloped wall towards the bladder. The sloped wall assists in preventing the foam retaining wall from becoming bowed by hydrostatic pressure since one of the vectors of resulting forces from the water pressure would tend to be in a downward direction. A more resilient foam similar to the foam pad 21 is placed over the whole structure.

Figure 7:
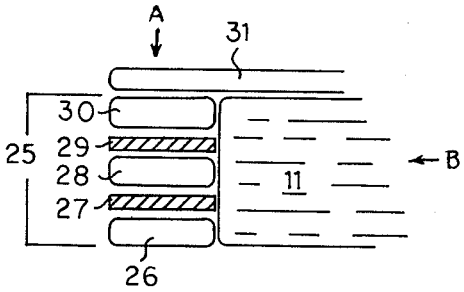
FIG. 7 is a cross-sectional view of a composite border for a water mattress employing a solid rigid member interposed between foam panels.
Figure 8:
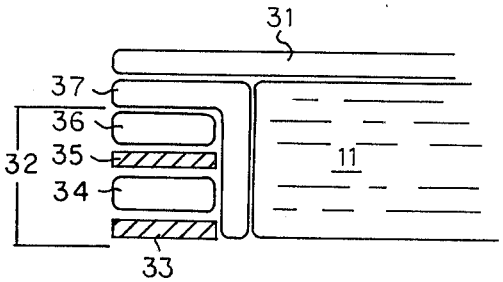
FIG. 8 is a cross-sectional view similar to FIG. 7.

FIGS. 7 and 8 illustrate retaining walls utilizing a slightly different variable rigidity principle wherein foam slabs are stacked with a solid rigid material such as wood or solid plastic or aluminum to form a retaining wall. FIG. 7 illustrates one embodiment wherein the bladder 11 is retained in place by a wall 25 which is composed of a relatively rigid dense foam slab 26, a thin rigid member 27 of wood, plastic, aluminum, steel or the like, another foam slab 28 on top of the rigid member wherein the foam slab 28 may be of a more resilient foam with another thin rigid member 29 and a foam slab 30 of low density and high flexibility and resiliency as the top member of the retaining wall 25. The various slabs within the retaining wall are adhered together.

The principle involved in these structures is that the thin rigid members will flex significantly when a vertical force is applied as shown by the arrow A. Such a vertical force would be caused by a person sitting on the edge of the bed or lying near the edge of the bed. The structure is, however, very resistant to a lateral force such as that shown by arrow B. Thus, a box frame work having a retaining wall of these composite structures would be exceptionally comfortable to sit upon but would be as unyielding or even more unyielding than structures wherein a thin section of the rigid member was exposed to a lateral, perpendicular force, for example as shown in FIG. 1.

A foam pad 31, which may be similar to pads 21 and 24, may be utilized to cover the structures of FIGS. 7 and 8. An advantage of having a base foam section 26 provides for a comfortable feel to the mattress when it is lifted for the purpose of tucking a sheet or fitting a sheet about the mattress.

FIG. 8 shows a slight variation upon the structure of FIG. 7 wherein the composite wall 32 is composed of a base rigid section 33 which is a very thin cross-section. A medium flexible foam 34, a thin rigid slab 35 and a more flexible foam 36 adhered thereupon. A flexible foam 37 is shown which interfaces between the retaining wall and the bladder 11 and overlaps the top of the retaining wall. A pad 31 may be placed upon the whole structure.

Foams for the various rigidities, flexibilities and densities suitable for the various purposes indicated above are listed as follows:

I. Flexible plastic foams particularly useful as the insulating pad above the mattress and upper foam panels in a composite border have an ILD* of about 12 to 18 lbs. and a density of about 1.0 to about 1.3 lbs/ft.$^3$.

II. Intermediate flexible plastic foams such as those used as a base layer in conjunction with a rigid solid member have an ILD* of about 60 to about 80 lbs. and a density of about 1.6 to about 2.0 lbs/ft.$^3$.

III. More rigid foams which still have substantial resiliency useful as self-supporting restraining members have an ILD* greater than 100 lbs. and a density of about 3.2 lbs/ft.$^3$ and greater.

IV. Flexible foams useful in the composite structures as intermediate panels may have ILD's* ranging from about 20 to about 50 and densities of about 1.4 to about 1.6 lbs/ft.$^3$.

*ILD (Indentation Load Deflection) is a measure of resiliency. The ILD for a particular foam represents the number of pounds of force (weight) upon a square foam piece 15 inches by 15 inches and 4 inches thick to cause 25% deflection.

Figure 9:
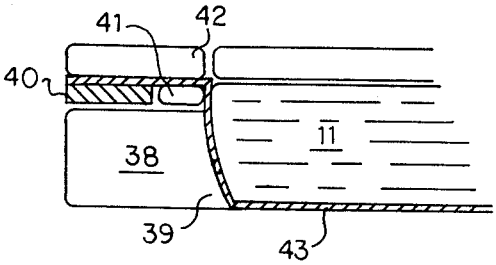
FIG. 9 is a cross-sectional view of a composite border for a water mattress wherein a single, solid rigid member is interleaved between flexible foam members.

Another structure employing the variable rigidity principle is illustrated in FIG. 9. A base foam slab 30 having a sloping interior wall 39 encloses a water bladder. Although a sloping interior wall is illustrated, it is understood, of course, that such wall may be vertical. A flat rigid member 40, such as a board, is adhered to the upper surface of the foam slab 38. Four such rigid members are joined at each end to form a peripheral rigid frame work. An inner foam slab 41 having the same height (thickness) as member 40 is adhered to the upper surface of cushion 38 and spaces the rigid member from the water-filled bladder 11.

An upper resilient foam slab 42 is disposed above member 40 and foam slab 41. A water impervious liner 43 extends under the whole bladder and extends along each sloping side 39 of slab 38 to form a safety reservoir. The liner is preferably extended over slab 41 to be stapled or glued to rigid member 40. Slab 42 is adhered to the portion of the liner 43 disposed between slab 42 and member 40 and slab 41.

The structure illustrated in FIG. 9 is particularly effective and easy to construct. It also provides an exceptionally comfortable seating area about the periphery of the mattress. Also, it provides an extremely comfortable sleeping surface since any rigid members are outside the normal sleeping area.

The structure provides for a rigid member, e.g., a board 40, whose width is substantially greater than its thickness, e.g., a nominal thickness of about one-half to one inch and a width of about two and one-half to about four inches, base is particularly useful. The wider dimension is in a horizontal plane to offer maximum lateral support to the water-filled bladder yet being deflectable by a vertical force. Thus, the structure is exceptionally comfortable to sit upon even when the foam layer is relatively thin, e.g., one to two inches in thickness. Thicker foam layers, e.g., three to four inches over the rigid board make the presence of the board imperceptible to anyone sitting along an edge of the mattress.

A narrow foam strip 41 protects the bladder from the rigid member and also tends to dampen wave formation within the bladder. The strip is preferably as thick as the rigid member and is overlapped by the impervious liner 43 to form a safety reservoir substantially as deep as the water-filled bladder.

The foam member 42 may be a strip which encircles the entire perimeter and which is at least as wide as the rigid member. Also, the strip 42 may be eliminated with the overlapping pad extending to the edges of the bed.

The whole mattress is preferably encased in a coverlet to give it an appearance similar to a conventional inner-spring or foam mattress.

If desired, an underlying plastic strip may be adhered to the base of foam member 38 to provide additional lateral support. Such a construction is unnecessary however whenever the mattress depth does not exceed about eight inches and the filled bladder depth is less than about six inches. The foam member 38 is adhered to rigid member 40 to provide a nonsagging structure.

The rigid member 40 can be placed in any vertical location from a position in about the same horizontal plane as the upper level of the water-filled bladder to a position near the base of the structure. Preferably the rigid member is located at a position about one-fourth the distance above the base of the bladder to a position in a horizontal plane which is near the top of the water-filled bladder. The rigid member could be located at the base of the mattress, however, it is generally preferred to have at least one to two inches of foam under the rigid member to give the corners of the mattress the feel of a foam mattress and to protect the corners of any enclosing coverlet.

We claim:

1. In a mattress construction having a conventional thickness;

a water mattress comprising a flexible bladder for holding a body of water;

a peripheral restraining member for providing lateral support in all directions for said water mattress, said restraining member comprising:

an encircling flexible foam restraining member having a substantially vertical surface adjacent said bladder and having a height at least as great as said bladder when said bladder is filled with water, said foam restraining member forming a cavity for said water mattress, a peripheral rigid box-like member in contact with the outer surface of said foam restraining member remote from said bladder, said rigid box-like member having a height no greater than the height of said bladder when said bladder is filled with water, a foam cushion superposed upon the upper surface of said rigid box-like member to a height substantially level with the upper surface of said foam restraining member.

2. The mattress of claim 1 wherein a water impervious liner is disposed under said bladder and has its edges turned up along the innermost facial surfaces of the foam restraining member to form a safety reservoir.

3. The mattress of claim 1 wherein said peripheral rigid box-like member has a height which is no greater than about one-half the height of said bladder when said bladder is filled with water.

4. The mattress of claim 1 wherein the encircling flexible foam restraining member has a minimal cross-sectional width of at least four inches.

5. The mattress of claim 1 wherein the foam cushion above the upper surface of said rigid restraining member is at least five inches high.

6. The mattress of claim 1 wherein a thin flexible cushion is coextensive with the bottom surface of said rigid box-like frame.

7. The mattress of claim 1 wherein a quilted coverlet having a top quilted panel, side panels and a bottom panel completely covering said mattress.

8. In a water mattress construction having a bladder, surrounded by a retaining member, the improvement comprising a retaining member having a composite structure, said composite structure comprising:

a rigid member having a cross-sectional width greater than its height and sufficient rigidity to provide substantial lateral support for said bladder filled with water, said height having substantially less than the height of said bladder filled with water;

an upper member of flexible foam having a width substantially no greater than said rigid member, said upper member being fixedly attached to said base member and substantially more flexible than said base member, said upper member having a height sufficient to provide a combined height of base and upper member at least as great as the height of said water filled bladder.

9. The improvement of claim 8 wherein said base member has a cross-sectional width at its bottom surface greater than at its top surface to provide a sloping surface adjacent said bladder.

10. The improvement of claim 8 wherein said cross-strap supports interconnect the base member of each leg of the surrounding member at its mid-point to the longitudinal mid-point of the opposing leg to improve the lateral support of said retaining member to each water filled bladder.

11. The improvement of claim 8 wherein said base member is a substantially rigid foam of low density.

12. The improvement of claim 8 wherein said base member is a wooden member having a width substantially greater than its thickness.

13. The improvement of claim 13 wherein said wooden base member is supported by a contiguous adjacent flexible foam member.

14. The improvement of claim 8 wherein a surface pad having a cross-sectional width at least as great as the upper member is contiguous with the top surface of said upper member and is at least as flexible as said top member.

15. In a mattress having a conventional thickness:

a water mattress comprising a flexible bladder for holding a body of water;

a peripheral restraining member for providing lateral support along at least the longer sides of said water mattress, said restraining member comprising:

a flexible foam restraining member adjacent along at least each longer side of said bladder and having a height substantially as great as said bladder when said bladder is filled with water, a peripheral rigid box-like frame having said members in contact with a surface of said foam restraining member remote from said bladder, said rigid side members having a vertical thickness substantially less than their width, a resilient foam cushion superposed upon the upper surface of said side members of said rigid box-like frame.

16. The mattress of claim 15 wherein said flexible foam restraining member has portions adjacent to said rigid side members.

17. The mattress of claim 16 wherein the rigid side member is a board having a nominal thickness of about one-half to about one inch and a nominal width of about two and one-half to about four inches.

18. The mattress of claim 15 wherein the resilient foam cushion above said rigid side member has a thickness of at least about two inches.

19. The mattress of claim 1 wherein the encircling flexible foam member has a height greater than its width.

20. The mattress of claim 1 wherein the peripheral rigid box-like member has a height substantially less than the height of the bladder.

* * * * *